US005842235A

United States Patent [19]

Miyazaki

[11] Patent Number: 5,842,235

[45] Date of Patent: Dec. 1, 1998

[54] OPENING/CLOSING DEVICE FOR OPENING/CLOSING BODIES

[75] Inventor: Kanetsugu Miyazaki, Kanagawa, Japan

[73] Assignee: Katoh Electrical Machinery Co., Ltd., Kanagawa, Japan

[21] Appl. No.: 957,166

[22] Filed: Oct. 24, 1997

[30] Foreign Application Priority Data

Oct. 28, 1996 [JP] Japan ..... 8-285703

[51] Int. Cl.[6] ..... A47K 13/12

[52] U.S. Cl. ..... 4/236; 4/240; 4/234

[58] Field of Search ..... 4/234, 236, 240, 4/235, 237, 242.1; 16/280, 285, 307, 308, 342

[56] References Cited

U.S. PATENT DOCUMENTS

| | | | |
|---|---|---|---|
| 2,104,947 | 1/1938 | Joosten | 4/234 |
| 4,780,914 | 11/1988 | Lin | 4/236 |
| 5,165,507 | 11/1992 | Ohshima | 4/236 |
| 5,279,000 | 1/1994 | Mercier et al. | 4/240 |

*Primary Examiner*—David J. Walczak
*Assistant Examiner*—Tuan N. Nguyen
*Attorney, Agent, or Firm*—Notaro & Michalos P.C.

[57] ABSTRACT

In order to control the rotational torque of opening/closing bodies, such as seats and lids for Western-styled lavatory stool, allowing them to be easily opened, stopped and held stably in an opened state, and preventing them from dropping abruptly when they are closed, the present invention provides an opening/closing device with a pair of brackets fitted on two sides at the upper end of the rear part of a lavatory stool and a pair of cases, one for each of the pair of brackets, for bearing and holding one side of a corresponding bracket. A holder housing receives each of these cases, and has a fitting part for a lavatory lid, and is disposed rotatably between the pair of brackets. A pair of supporting members for the lavatory is positioned outside the brackets, and is borne and held by the cases. A rotating shaft with a rotation controller is provided within each case, one of these rotating shafts being disposed so as to rotate together with the holder and the other being disposed so as to rotate together with the supporting members.

6 Claims, 7 Drawing Sheets

OPENING/CLOSING DEVICE FOR OPENING/CLOSING BODIES

BACKGROUND OF THE INVENTION

1. Field of the Invention

The present invention relates to an opening/closing device for opening/closing bodies such as a wooden seat or lid opening and closing vis-a-vis a Western-styled lavatory stool, and more particularly to an opening/closing device suitable for an opening/closing body whose abrupt drop in the course of closing is desired to be prevented.

2. Description of the Prior Art

Wooden seats and lids have been publicly known for use with Western-styled lavatory stools.

A wooden seat or lid, which is heavier than a plastic one, if dropped abruptly, may make a noise loudly or injure the user's hand if caught between it and the stool, and is heavier to open.

Accordingly, there is a keen requirement for an opening/closing device which could allow a wooden lavatory seat or lid to be easily opened and to steadily hold itself in an upright position and, when the seat or lid is to be closed, prevent it from dropping abruptly. As the users' requirements as well as the dimensions and weight of the seat and lid are diverse, it a case having a rotating shaft on which rotation control means having various torque curves is caused to act, and is fitted replaceably, a single opening/closing device can conveniently meet the users' diverse needs and the different dimensions and weights of seats and lids, and serves to reduce the cost.

SUMMARY OF THE INVENTION

A first object of the present invention is to provide an opening/closing device which can control the rotational torque of an opening/closing body, such as a lavatory seat or lid, and has a simple configuration which allows a lavatory seat or lid to be easily opened and to steadily hold itself in an open position and, when the seat or lid is to be closed, prevents it from dropping abruptly.

A second object of the invention is to provide an opening/closing device for an opening/closing body, enabled to create diverse torque covers merely by replacing a case having a rotating shaft on which rotation control means is caused to act.

In order to achieve the aforementioned objects, according to the invention, there is provided an opening/closing device consisting of a pair of brackets fitted on two sides at the upper end of the rear part of a lavatory stool; a pair of cases, one for each bracket of the pair of brackets, for bearing and holding one side of the corresponding bracket; a holder housing for receiving part of each of these cases, having a fitting part for a lavatory seat or lid, and disposed rotatably between said pair of brackets; and a pair of supporting members having a fitting part for the lavatory lid or seat positioned outside said brackets, and borne and held by said cases; wherein a rotating shaft, on which rotation control means is caused to act, is provided within each of said cases, one of these rotating shafts being disposed so as to rotate together with said holder and the other being disposed so as to rotate together with said supporting members.

In this configuration, the invention enables part of said pair of cases to be detachably borne and held by said pair of brackets, the remaining part of said pair of cases to be detachably housed in said holder, and said pair of supporting members to be detachably borne and held by said pair of brackets and/or cases.

According to the invention, there is also provided an opening/closing device consisting of a pair of brackets fitted on two sides at the upper end of the rear part of a lavatory stool; a pair of cases, each for one bracket of the pair of brackets, for bearing and holding one side of the corresponding bracket; a holder housing for receiving part of each of these cases, having a fitting part for a lavatory seat or lid, and disposed rotatably between said pair of brackets; and a pair of supporting members having a fitting part for the lavatory lid or seat positioned outside said brackets, and borne and held detachably by said cases; wherein a rotating shaft, on which rotation control means is caused to act, is provided within each of said cases, one of these rotating shafts being disposed so as to rotate together with said holder and the other being disposed so as to rotate together with said supporting members, and each of the rotation control means caused to act on said rotating shafts is a torsion spring caused to act between said rotating shaft and cases.

According to the invention, there is further provided an opening/closing device consisting of a pair of brackets fitted on two sides at the upper end of the rear part of a lavatory stool; a pair of cases, each for one bracket of the pair of brackets, for bearing and holding one side of the corresponding bracket; a holder housing for receiving part of each of these cases, having a fitting part for a lavatory seat or lid, and disposed rotatably between said pair of brackets; and a pair of supporting members having a fitting part for the lavatory lid or seat positioned outside said brackets, and borne and held by said cases; wherein a rotating shaft, on which rotation control means is caused to act, is provided within each of said cases, one of these rotating shafts being disposed so as to rotate together with said holder and the other being disposed so as to rotate together with said supporting members, and said rotation control means caused to work on each of said rotating shafts is composed of a fixed cam provided within the case, a rotating-sliding cam, opposite to this fixed cam, fitted so as to freely slide on the rotating shaft and to rotate together with the rotating shaft, and a spring pressing this rotating-sliding cam toward the fixed cam.

According to the invention, there is further provided an opening/closing device consisting of a pair of brackets fitted on two sides at the upper end of the rear part of a lavatory stool; a pair of cases, for the pair of brackets, for bearing and holding one side of the corresponding bracket; a holder housing for retaining part of each of these cases, having a fitting part for a lavatory seat or lid, and disposed rotatably between said pair of brackets; and a pair of supporting members having a fitting part for the lavatory lid or seat positioned outside said brackets, and borne and held by said cases; wherein a rotating shaft, on which rotation control means is caused to act, is provided within each of said cases, one of these rotating shafts being disposed so as to rotate together with said holder and the other being disposed so as to rotate together with said supporting members, and one of said rotation control means caused to work on each of said rotating shafts is composed of a torsion spring caused to act on said rotating shaft, while the other is composed of a fixed cam provided within the case to let said rotating shaft penetrate rotatably, a rotating-sliding cam, opposite to this fixed cam, fitted so as to freely slide on the rotating shaft and to rotate together with the rotating shaft, and a spring provided between this rotating-sliding am and the fixed cam, wound around said rotating shaft, and pressing said rotating-sliding cam toward said fixed cam.

DETAILED DESCRIPTION OF THE PREFERRED EMBODIMENT

Figure 1:
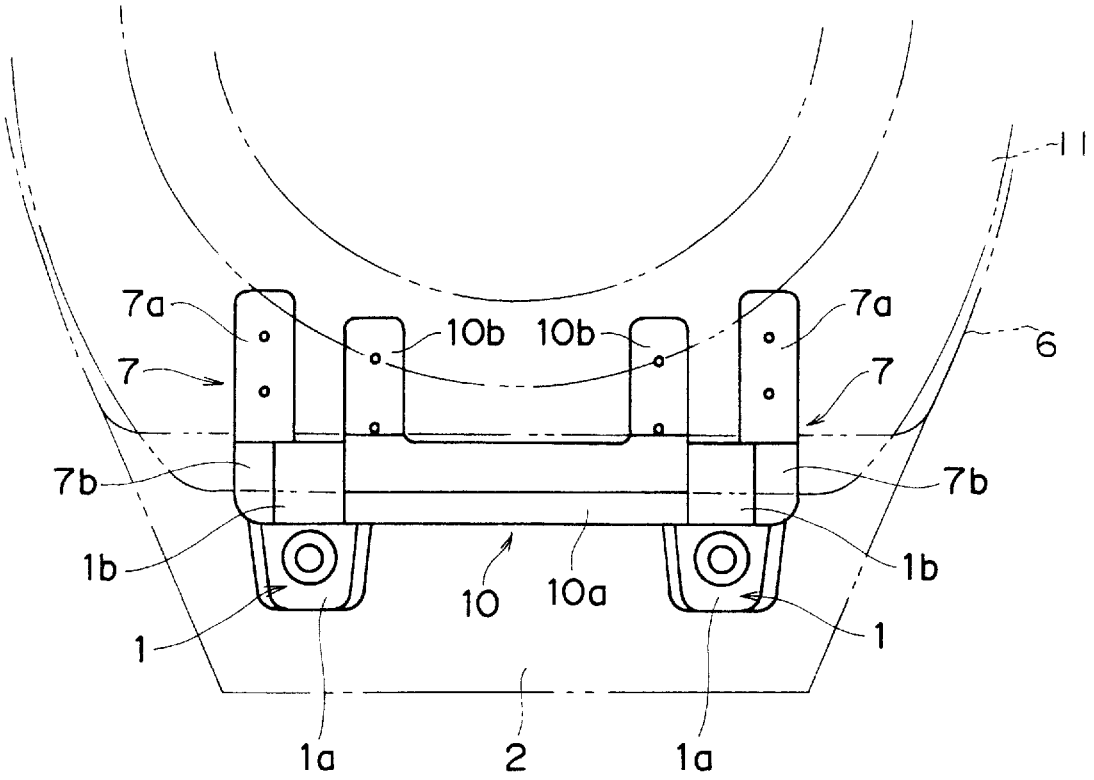
FIG. 1 is a plan of an opening/closing device for opening/closing bodies according to the invention being applied to an opening/closing body such as the seat, lid or the like of a Western-styled lavatory stool.
Figure 2:
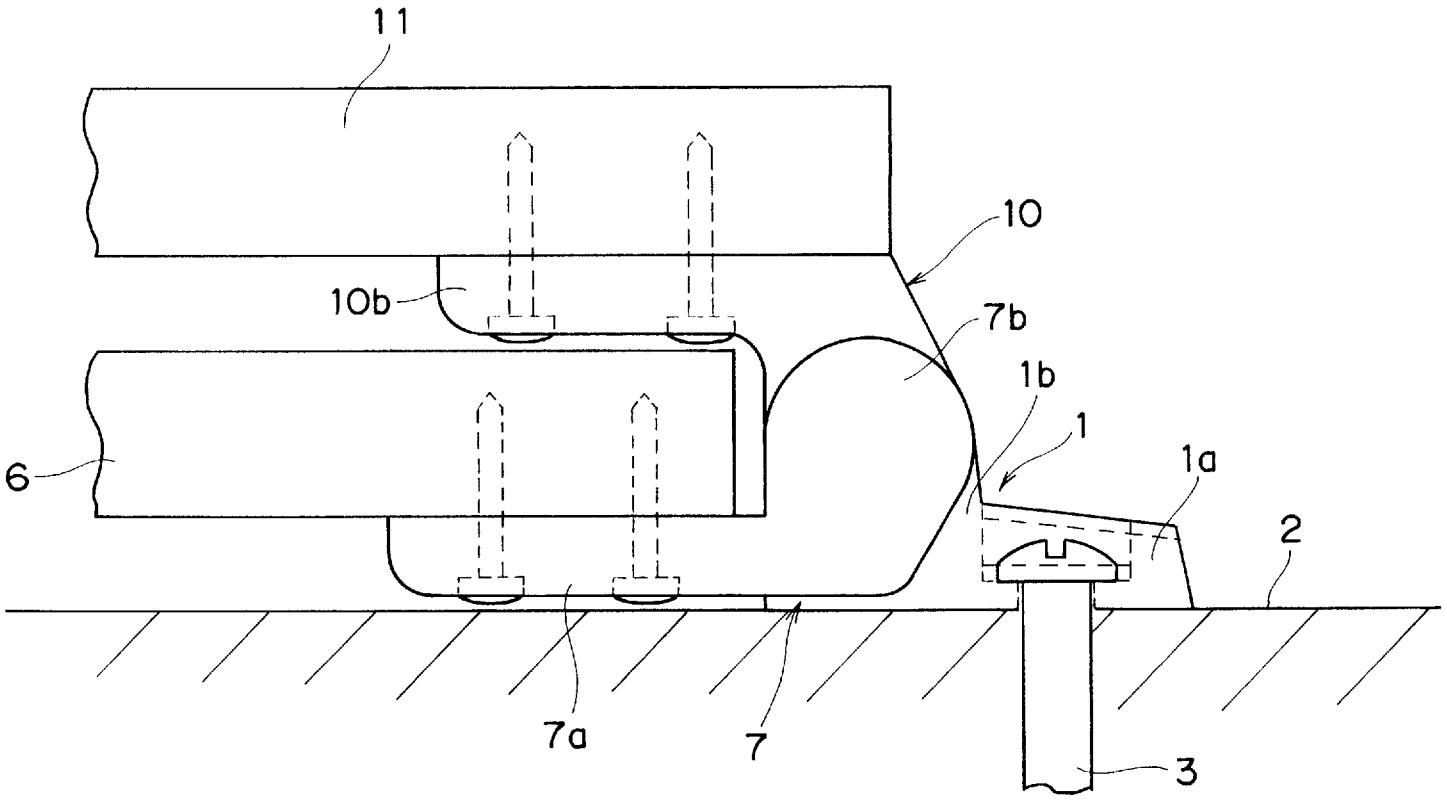
FIG. 2 is a partially enlarged cross-sectional profile of the device illustrated in FIG. 1.
Figure 3:
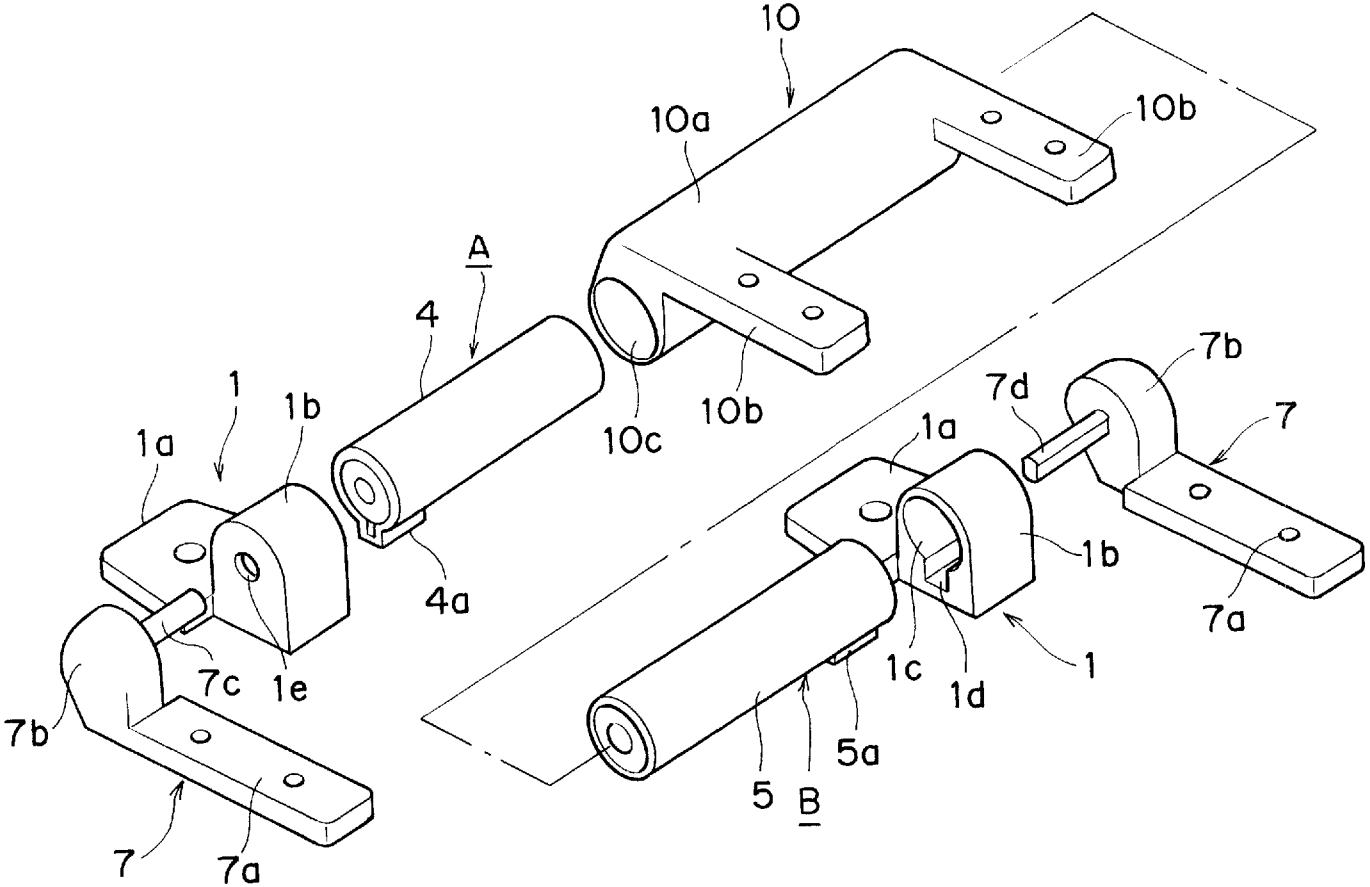
FIG. 3 is a partially exploded perspective view of an opening/closing device for opening/closing bodies according to the invention.

Whereas a preferred embodiment of the present invention, which represents an application thereof to opening/closing bodies, such as the seats, lids or the like of Western-styled lavatory stools, is described below, the invention is not limited to this embodiment, but is applicable to a broad range of opening/closing bodies.

In the drawings, reference numeral 1 denotes a pair of brackets each consisting of a fitting section 1*a* and a bearing section 1*b,* and the fitting sections 1*a* are fastened to the upper end of the rear part of a Western-styled lavatory stool 2 at a prescribed spacing between them with bolts 3. In a keyhole-shaped bearing hole 1*c* provided in each of the bearing section 1*b* is borne a cylinder-shaped case 4 or 5, with one of its ends inserted into the hole. The cases 4 and 5 themselves are non-rotatably borne and held by the brackets 1 as due to the engaging of projections 4*a* and 5*a,* provided on the circumferences of the cases 4 and 5, respectively, with grooves 1*d* provided in the bearing holes 1*c.*

On the external sides of the brackets 1 are arranged a pair of supporting members 7 for a wooden lavatory seat 6, fixed to fitting sections 7*a* of these supporing members 7, at the rear end of the seat. Supporting shafts 7*c* and 7*d* projecting from bearings 7*b* of the numbers 7, extend into holes 1*e,* these shafts being borne by shaft holes 8*a* and 9*a* bored into a bearing cylinder 8 and a rotating cylinder 9 in the cases 4 and 5. The configuration of these constituent elements is such that, while the left-side supporting shaft 7*c* and the shaft hole 8*a* to accommodate the shaft 7*c* have circular cross sections, the right-side supporting shaft 7*d* and the shaft hole 9*a* to accommodate the shaft 7*d* have substantially oval cross sections so that, though the supporting shaft 7*c* and the left-side supporting member 7 do not rotate together with the bearing cylinder 8 but rotate independently, the supporting shaft 7*d* and the right-side supporting shaft 7 do rotate together with the rotating cylinder 9.

Between the brackets 1 is arranged a holder 10 comprising a cylindrical section 10*a* and a pair of fitting sections 10*b* projecting from the middle part of the cylindrical section 10*a* in its radial direction with a prescribed spacing between them. The cases 4 and 5 are housed in accommodating holes 10*c* and of the cylindrical section 10*a.* To the fitting sections 10*b* is fastened the rear end of a lavatory lid 11. The fitting sections 7*a* and 10*b* of the seat 6 and the lid 11, respectively, may as well be disposed in a reverse way to the above-described embodiment, i.e. the rear end of the lid 11 being fitted to the fitting sections 7*a* for the seat 6 and that of the seat 6 being fitted to the fitting sections 10*b* for the seat 11.

Figure 4:
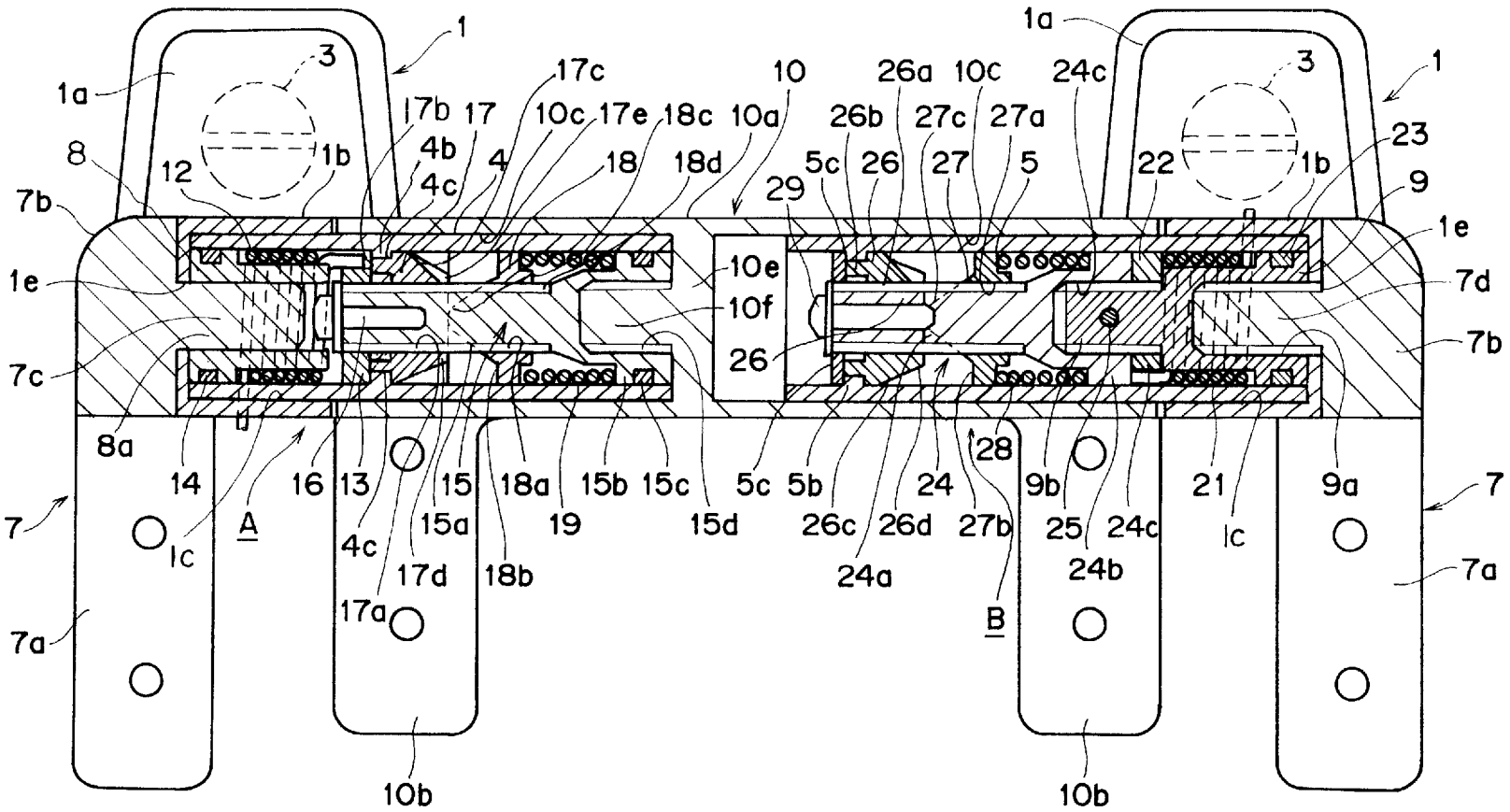
FIG. 4 is a cross-sectional plan of the internal structure of an opening/closing device for opening/closing bodies according to the invention.

Next is described rotation control means, first A on the left side in FIG. 4. A side part of the above-described bearing cylinder 8 is rotatably housed in a side part of the left-side case 4 borne and held by the bearing part 1*b* of the bracket 1, and around this bearing cylinder 8 is wound a torsion spring 12, of which one end is held onto the case 4 and the other end, to a collar 13. Incidentally, reference numeral 14 denotes an O ring. The collar 13 is engaged with one end of a rotating shaft 15, and fastened to it with a fitting screw 16 so that it may not come off. The rotating shaft 15 is housed rotatably in the case 4 in its axial direction by having a diaphragm 4*b* bearing a side part of a deformed axial part 15*a* and a large diameter part 15*b* provided at the other end borne within the case 4. Incidentally, reference numeral 15*c* denotes another O ring. To this rotating shaft 15 are fitted a fixed cam 17 and a rotating-sliding can 18*a* with its deformed axial part 15*a* penetrating or engaging with a penetrating hole 17*a* and a deformed hole 18, and while the fixed cam 17 is non-rotatably fixed to the diaphragm 4*b* by fitting projections 17*b* into holding holes 4*c* bored in the diaphragm 4*b,* the rotating-sliding cam 18 rotates together with the rotating shaft 15 and is free to slide. Between this rotating-sliding cam 18 and the large diameter part 15*b* is elastically provided a compression spring 19, wound around the rotating shaft 15, to constantly press the rotating-sliding cam 18 to slide toward the fixed cam 17. The fixed cam 17 and the rotating-sliding cam 18 are respectively provided with pairs of concave parts 17*c* and 18*b* and convex parts 17*d* and 18*c* in mutually opposite positions.

A holding hole 15*d* having a substantially oval cross section is provided on the large diameter 15*b* side of the rotating shaft 15, and a supporting shaft 10*f* having a substantially oval cross section, projecting from a partitioning wall 10*e* within the holder 10 in the axial direction, is inserted and held in this holding hole 15*d,* so that the rotating shaft 15 rotate together with the holder 10.

Next is described rotation control means B on the right side in FIG. 4. A side part of the above-described rotating cylinder 9 is rotatably housed in a side part of the right-side case 5 borne and held by the bearing part 1*b* of the bracket 1, and around this rotating cylinder 9 is wound a torsion spring 21, of which one end is held onto to the case 5 and the other end, to a collar 22. Incidentally, reference numeral 23 denotes an O ring. The collar 22 is engaged with a deformed axial part 9*b* protecting from one end of the cylinder 9, and this deformed axial part 9*b* is fit into a deformed holding hole 24*c* provided in the shaft core part of a large diameter part 24*b* of a rotating shaft 24 in the axial direction, and fastened with a fixing pin 25 compressedly inserted in the radial direction of the large diameter part 24*b* so that the large diameter part 24*b* may not come off. The rotating shaft 24 is housed rotatably in the case 5 in its axial direction by having a diaphragm 5*b* bearing a side part of a deformed axial part 24*a* and the large diameter part 24*b* provided at the other end borne within the case 4. The rotating shaft 24 is also held onto a diaphragm 5*b* with a fitting screw 29 so that it may not come off. To the rotating shaft 24 is fitted a fixed cam 26 and a rotating-sliding cam 27 with its deformed axial part 24*a* penetrating or engaging with a penetrating hole 26*a* and a deformed hole 27*a,* and while the fixed cam 26 is non-rotationally fixed to the diaphragm 5*b* by fitting projections 26*b* into holding holes 5*c* bored in the diaphragm 5*b,* the rotating-sliding cam 27 rotates together with the rotating shaft 24 and is free to slide. Between this rotating-sliding cam 27 and the large diameter part 24*b* is elastically provided a compression spring 28, wound around the rotating shaft 24, to constantly press the rotating-sliding cam 27 to slide toward the fixed cam 26. The fixed cam 26 and the rotating-sliding cam 27 are respectively provided with pairs of concave parts 26*c* and 27*b* and convex parts 26*d* and 27*c* in mutually opposite positions.

As the large diameter part 24*b* of the rotating shaft 24 and the rotating cylinder 9 are engaged with each other as stated above, the rotating shaft 24 is so disposed as to rotate together with the supporting member 7 on the right side of the seat 6 via the rotating cylinder 9.

Figure 5:
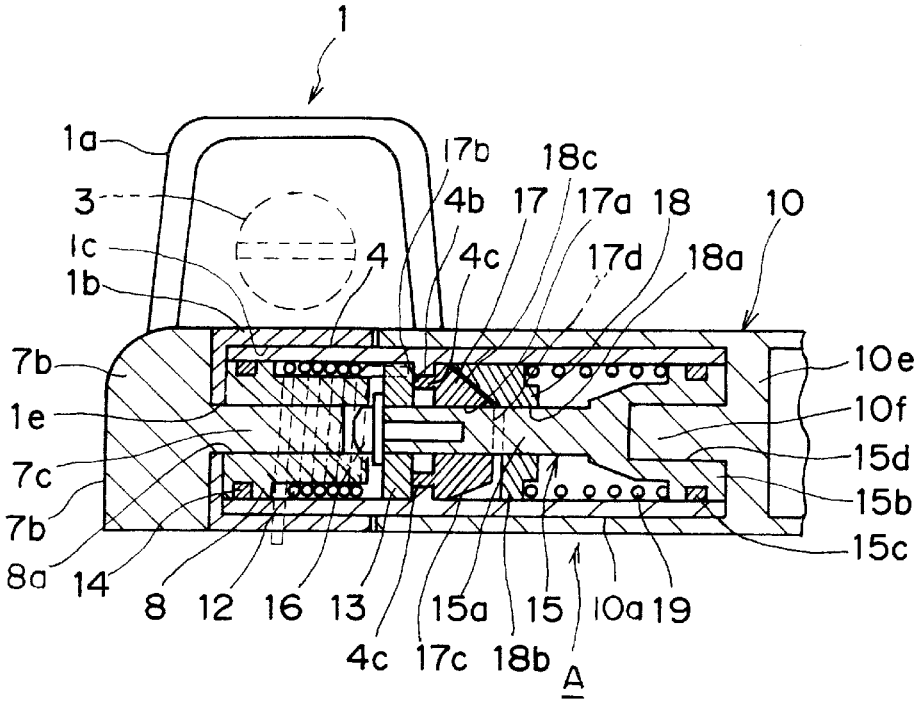
FIG. 5 is a cross-sectional plan for describing the operation of rotation control means A of an opening/closing device for opening/closing bodies according to the invention.

Next is described the operation of the rotation control means A on the left side of FIGS. 4 and 5.

When the lid 11 is opened or closed, the holder 10 rotates together, and the rotating shaft 15 rotates with the rotation of the holder 10 as the case 4 is held onto the bracket 1 and the rotating shaft 15 is held onto the supporting shaft 10*f* of the holder 10.

First, when the lid 11 is in a closed state, the torsion spring 12 is wound to the limit as illustrated particularly in FIG. 4, and the fixed cam 17 and the rotating-sliding cam 18 are in a state wherein the convex parts 17*d* and 18*c* of their respective cam parts 17*e* and 18*d* are in contact with each other, and the compression spring 19 is also compressed to the maximum.

When the lid 11 in this state is opened, because the torsion spring 12 is pressing the lid 11 in the opening direction and the convex part 18*c* of the rotating-sliding cam 18 slides into the concave part 18*b* from the convex part 17*d* of the fixed cam 17, the lid 11 can be opened without causing the user to feel its real weight. When it is opened to an angle of 90°, the winding force of the torsion spring 12 drops with the result that the convex part 18*c* of the rotating-sliding cam 18 fully falls into the concave part 18*b* of the fixed cam 17 to stabilize the lid 11 and to prevent it from falling naturally. The lid 11 can be opened beyond this angle of 90° up to about 110° and, it there is a stopper (not shown), for instance a stopper installed between the circumference of the collar 13 and the inner wall of the case 4, the lid 11 will be stopped by this stopper or, if there is a water tank (not shown) behind the stool 2, it will be stopped as it hits this water tank.

When the opened lid 11 is to be closed, its motion is decelerated by the resistance working on the convex part 18*c* of the rotating-sliding cam 18 which has to climb a slope from the concave part 17*c* against the elasticity of the compression spring 19 and the repulsive force of the torsion spring 12 being wound, and the lid 11 is prevented from dropping abruptly.

Figure 6:
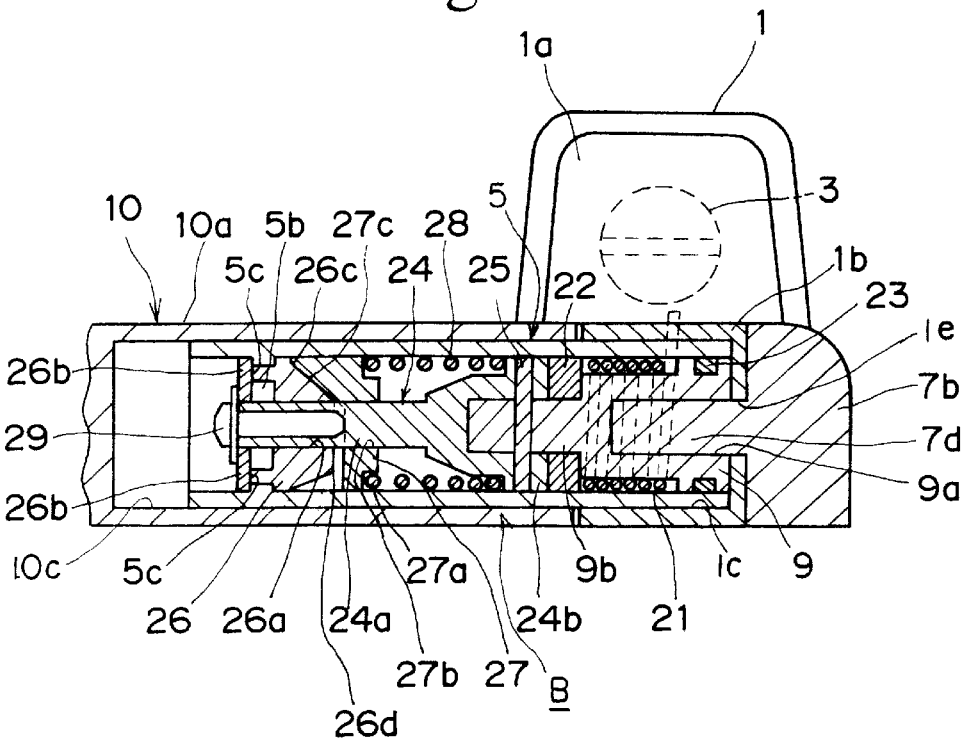
FIG. 6 is a cross-sectional plan for describing the operation of rotation control means B of an opening/closing device for opening/closing bodies according to the invention.
Figure 7:
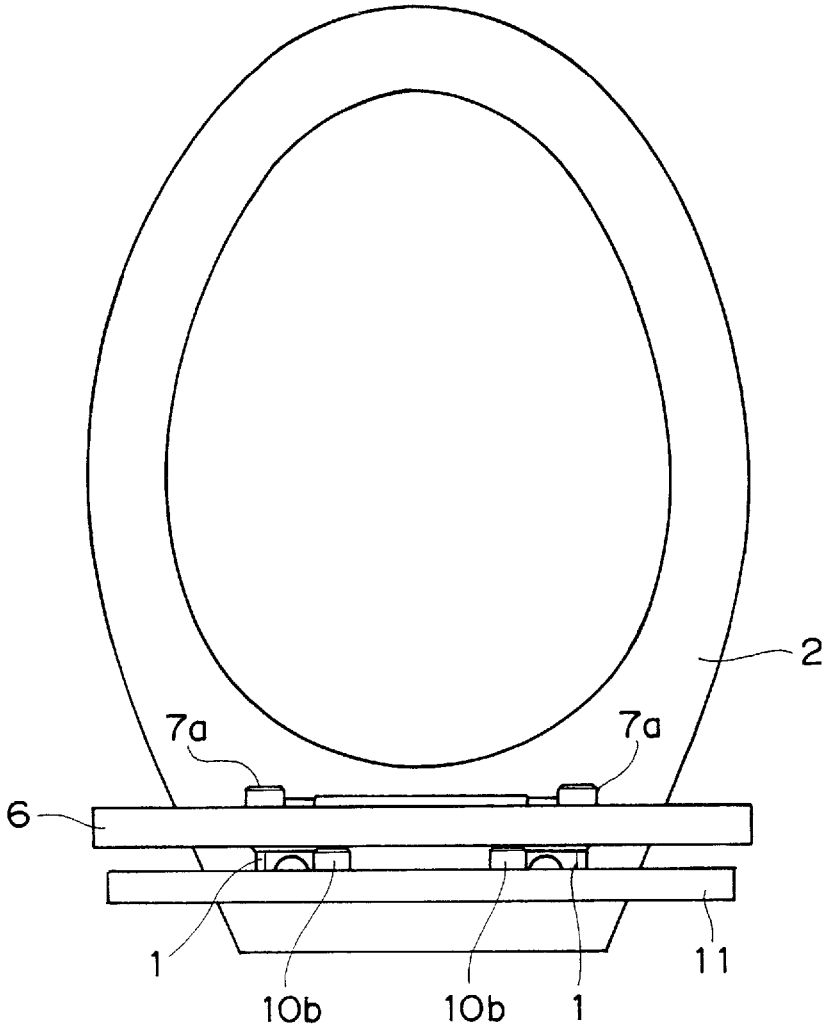
FIG. 7 is a plan of an opening/closing body, such as a lavatory seat, lid or the like opened to an angle of 90°.
Figure 8:
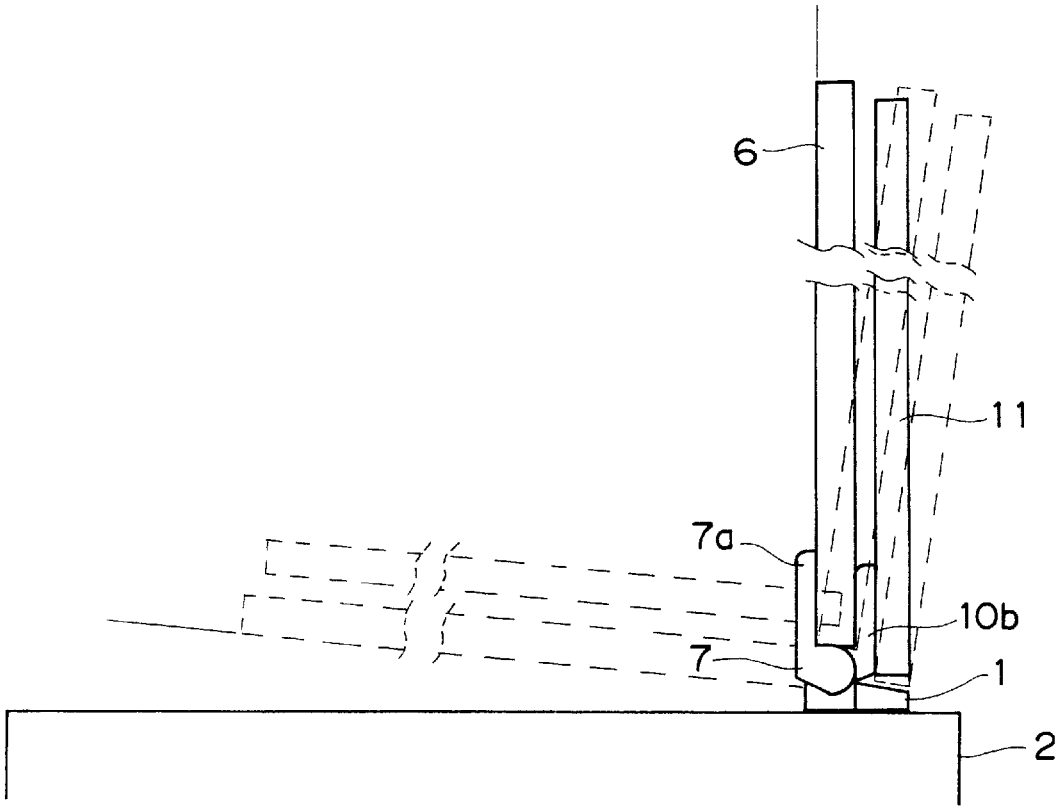
FIG. 8 is a profile of the state shown in FIG. 7.

Next is described the operation of the rotation control means B on the right side of FIGS. 4 and 6.

When the seat 6 is opened or closed, the holder 10 does not rotate together. Nor does the case 5 as it is held onto the bracket 1. However, the rotating shaft 24, as it is configured so as to rotate with the supporting member 7 of the seat 6 via the rotating cylinder 9, rotates with the opening/closing action of the seat 6 via the rotating cylinder 9.

First, when the seat 6 is in a closed state, the torsion spring 21 is wound to the limit as illustrated particularly in FIG. 4, the fixed cam 26 and the rotating-sliding cam 27 are in a state wherein the convex parts 26*d* and 27*c* of their respective cam 26*e* and 27*d* are in contact with each other, and the compression spring 28 is also compressed to the maximum.

When the seat 6 in this state is opened, because the torsion spring 21 is pressing the seat 6 in the opening direction and the convex part 27*c* of the rotating-sliding cam 27 slides into the concave part 27*b* from the convex part 26*d* of the fixed cam 26, the seat 6 can be opened without causing the user to feel its real weight. When it is opened to an angle of 90°, the winding force of the torsion spring 21 drops with the result that the convex part 27*c* of the rotating-sliding cam 27 fully falls into the concave part 26*b* of the fixed cam 26 to stabilize the seat 6 and to prevent it from falling naturally. The seat 6 can be opened beyond this angle of 90° up to about 110° and, if there is a stopper (not shown), for instance a stopper installed between the circumference of the collar 22 and the inner wall of the case 5, the seat 6 will be stopped by this stopper or, if there is a water tank (not shown) behind the stool 2, it will be stopped as it hits this water tank.

When the opened seat 6 is to be closed, its motion is decelerated by the resistance working on the convex part 27*c* of the rotating-sliding cam 27 which has to climb a slope from the concave part 26*c* against the elasticity of the compression spring 28 and the repulsive force of the torsion spring 21 being wound, and the seat 6 is prevented from dropping abruptly.

What is claimed is:

1. An opening/closing device for opening/closing bodies, comprising of:

a pair of brackets fitted on two sides at an upper end of a rear part of a lavatory stool;

a pair of cases between said pair of brackets, each casing being next to one bracket of the pair of brackets, for bearing and holding each bracket;

a holder housing for retaining part of each of said cases, said holder housing having a fitting section for a lavatory seat or lid, and disposed rotatably between said pair of brackets; and a pair of supporting members each having a fitting section for the lavatory lid or seat, said supporting members being positioned outside said brackets and being borne and held by said cases; wherein a pair of rotating shafts on which rotation control means is caused to act, one of said pair of rotating shafts being provided within each case of said pair of cases, one of said rotating shafts being disposed so as to rotate together with said holder housing and the other of said rotating shafts being disposed so as to rotate together with said supporting members.

2. An opening/closing device for opening/closing bodies, comprising of:

a pair of brackets fitted on two sides at an upper end of a rear part of a lavatory stool;

a pair of cases, each for one bracket of the pair of brackets, each case of the pair of cases being for detachably bearing and holding one side of one bracket;

a holder for detachably housing part of each case of said pair of cases, said holder having a fitting section for a lavatory seat or lid, and disposed rotatably between said pair of brackets; and a pair of supporting members each having a fitting section for the lavatory lid or seat positioned outside said brackets, and detachably borne and held by said cases; wherein a pair of rotating shafts on each of which rotation control means is caused to act, provided within each of said cases, one of said rotating shafts being disposed so as to rotate together with said holder and the other of said rotating shafts being disposed so as to rotate together with said supporting members.

3. An opening/closing device for opening/closing bodies, comprising of:

a pair of brackets fitted on two sides at an upper end of a rear part of a lavatory stool;

a pair of cases, each for one bracket of the pair of brackets, for bearing and holding one side of said one bracket;

a holder housing for receiving part of each of said cases, having a fitting section for a lavatory seat or lid, and disposed rotatably between said pair of brackets; and a pair of supporting members each having a fitting section for the lavatory lid or seat positioned outside said brackets, and borne and held by said cases; wherein a pair of rotating shafts on each of which rotation control means is caused to act, said rotating shafts being provided within each of said cases, one of said rotating shafts being disposed so as to rotate together with said holder housing and the other being disposed so as to rotate together with said supporting members, and each of the rotation control means caused to act on said rotating shafts is a torsion spring caused to act between said rotating shaft and cases.

4. An opening/closing device for opening/closing bodies, as claimed in claim 3, wherein part of said pair of cases is detachably borne and held by said pair of brackets, the remaining part of said pair of cases is detachably housed in said holder, and each of said pair supporting members is detachably borne and held by said brackets and/or cases.

5. An opening/closing device for opening/closing bodies, comprising of:

a pair of brackets fitted on two sides at an upper end of a rear part of a lavatory stool;

a pair of cases, each for one bracket of the pair of brackets, for bearing and holding one side of said one bracket;

a holder housing for receiving part of each of these cases, having a fitting section for a lavatory seat or lid, and disposed rotatably between said pair of brackets; and a pair of supporting members each having a fitting section for the lavatory lid or seat positioned outside said brackets, and borne and held by said cases; wherein a pair of rotating shafts on each of which rotation control means is caused to act, provided within each of said cases, one of said rotating shafts being disposed so as to rotate together with said holder housing and the other of said rotating shafts being disposed so as to rotate together with said supporting members, and said rotation control means caused to work on each of said rotating shafts is composed of a fixed cam provided within the case, a rotating-sliding cam, opposite to this fixed cam, fitted so as to freely slide on a respective rotating shaft and to rotate together with the rotating shaft, and a spring pressing this rotating-sliding cam toward the fixed cam.

6. An opening/closing device for opening/closing bodies, comprising of:

a pair of brackets fitted on two sides at an upper end of a rear part of a lavatory stool;

a pair of cases, each each of one bracket of the pair of brackets, for bearing and holding one side of said one bracket;

a holder housing for receiving part of each of these cases, having a fitting section for a lavatory seat or lid, and disposed rotatably between said pair of brackets; and a pair of supporting members having a fitting section for the lavatory lid or seat positioned outside said brackets, and borne and held by said cases; wherein a pair of rotating shafts on each of which rotation control means is caused to act, is provided within each of said cases, one of said rotating shafts being disposed so as to rotate together with said holder housing and the other of said rotating shafts being disposed so as to rotate together with said supporting members, and one of said rotation control means caused to work on each of said rotating shafts is composed of a torsion spring caused to act on the rotating shaft, while the other is composed of a fixed cam provided within the case to let said rotating shaft penetrate rotatably, a rotating-sliding cam, opposite to this fixed cam, fitted so as to freely slide on the rotating shaft and to rotate together with the rotating shaft, and a spring provided between this rotating-sliding cam and the fixed cam, wound around said rotating shaft, and pressing said rotating-sliding cam toward said fixed cam.

* * * * *